United States Patent [19]

Yacoe

[11] Patent Number: 4,825,602

[45] Date of Patent: May 2, 1989

[54] POLYHEDRAL STRUCTURES THAT APPROXIMATE AN ELLIPSOID

[76] Inventor: J. Craig Yacoe, 108 Harvey La., Chadds Ford, Pa. 19317

[21] Appl. No.: 111,451

[22] Filed: Oct. 22, 1987

[51] Int. Cl.[4] ..... E04B 1/32

[52] U.S. Cl. ..... 52/81; 52/DIG. 10

[58] Field of Search ..... 52/80, 81, DIG. 10

[56] References Cited

U.S. PATENT DOCUMENTS 3,255,557 6/1966 Strum ..... 52/81

3,646,718 3/1972 McKenna ..... 52/79

3,841,039 10/1974 Farnsworth, III .

OTHER PUBLICATIONS

Domebook II, ® 1971 by Pacific Domes, pp. 34–40, 111, 112, 124 and 126, copy in A.U. 354.

*Primary Examiner*—Henry E. Raduazo

*Attorney, Agent, or Firm*—Donald W. Huntley

[57] ABSTRACT

Polyhedral structures that approximate an ellipsoid made up of generally irregular polygons.

6 Claims, 2 Drawing Sheets

POLYHEDRAL STRUCTURES THAT APPROXIMATE AN ELLIPSOID

BACKGROUND OF THE INVENTION

Engineering for dome construction has, in the past, produced a wide variety of structural designs. Fuller, in U.S. Pat. No. 2,682,235, described a geodesic dome, composed of triangular panels arranged in a pattern of arcs. While widely used, the geodesic dome has many limitations and drawbacks, including the fact that the triangular panels result in junctions of five or six panels, and the point of intersection of a geodesic dome with a horizontal plane defines a zigzag pattern. This irregular base line makes it difficult to attach a geodesic dome to a horizontal foundation and the triangular panels make it difficult to incorporate basic architectural elements such as doors and windows.

Yacoe, in U.S. Pat. No. 4,679,361, describes a geotangent dome which solved many of the problems inherent in geodesic domes, but which still is an approximation of a sphere. A continuing need exists for dome structures which would provide a broad range of height to diameter ratios for the enclosure of space.

SUMMARY OF THE INVENTION

The instant invention provides polyhedral structures that approximate an ellipsoid of revolution which share the advantages of the spherical structures described in U.S. Pat. No. 4,679,361, and, in addition, permit the variation of the height to diameter ratio of a dome structure.

Specifically, the instant invention provides a polyhedral structure that approximates an ellipsoid, the ellipsoid having an equator and two poles, the structure composed of rings of polygonal faces, wherein each face in a ring is at the same latitude and each edge of each polygon is tangent to the approximated ellipsoid at one point, and in which the most equatorial ring of polygons contains more faces than the most polar rings.

DETAILED DESCRIPTION OF THE INVENTION

Figure 1:
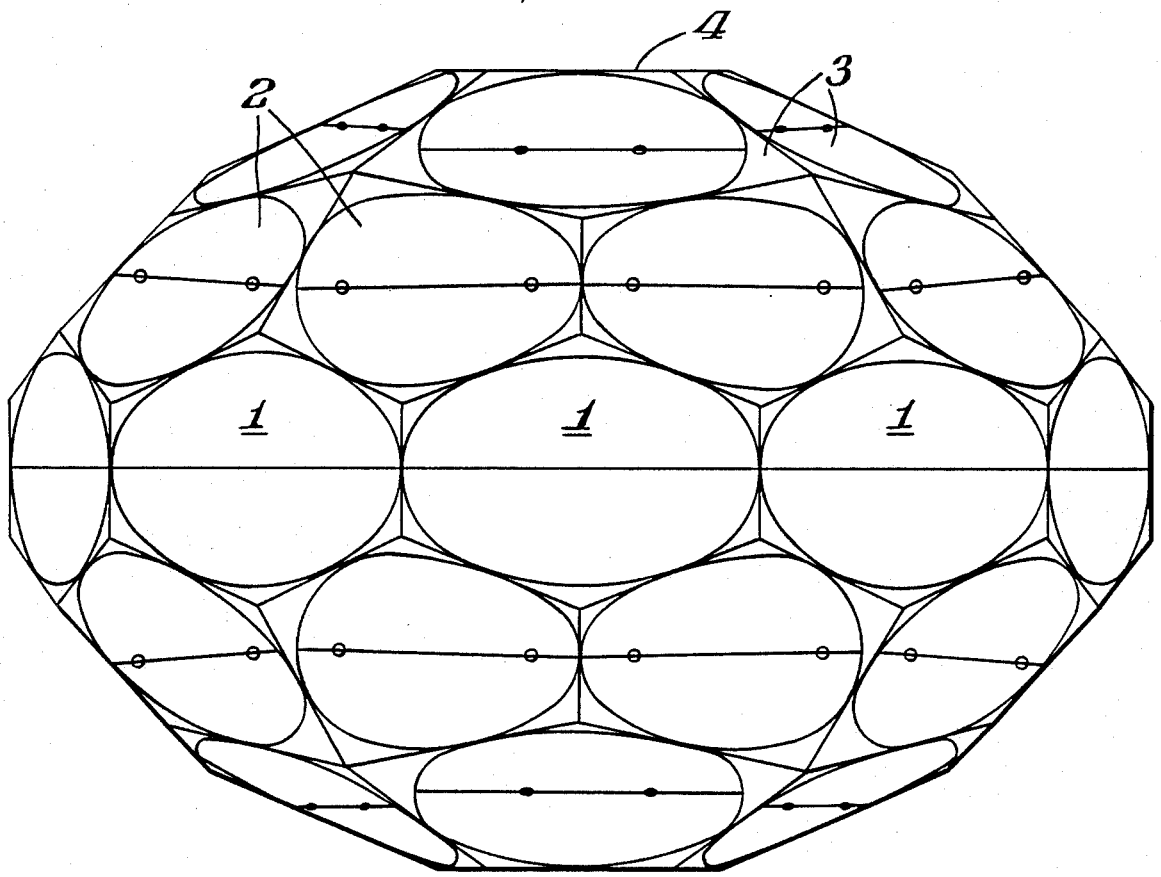
FIG. 1 is a side view of a geotangent ellipsoidal dome of the present invention with 10 faces at the equator.

The ellipsoidal structures of the present invention are similar to the spherical structures described in U.S Pat. No. 4,679,361, hereby incorporated by reference. The term geotangent domes will be understood to mean structures comprising a section of a polyhedron made up of rings of polygons, the edges of which are each tangent to the same sphere or ellipsoid of revolution and in which the most equatorial ring of polygons contains more faces than the most polar ring. All polygons in the same ring have inscribed circles or ellipses, the centers or foci of which are at the same spherical latitude.

The present structures, like the spherical geotangent domes, have an equatorial ring of polygons, each edge of each polygon being tangent to the approximated ellipsoid at one point. Successive rings of polygonal faces have from 4 to 8 sides, and an ellipse can be inscribed in each face which is tangent to each edge of the polygonal face.

In the present polyhedral structures, each vertex, that is, where more than two polygonal faces come together, is a junction of three or four polygonal edges. In addition, the ellipsoid which is approximated by the present polyhedrons touches each side of each polygon at only one point. Phrased differently, the ellipsoid that is approximated by a polyhedron of the present invention intersects each polygon at an inscribed ellipse within each polygonal face, and each such inscribed ellipse is tangent to the inscribed ellipse in each adjacent polygon.

The polyhedral structures of the present invention are generally characterized by at least fourteen faces. The ring of hexagons in the present polyhedrons at or closest to the equator of the approximated ellipsoid is six or more in number and is a power of 2 times an odd integer of 1 to 9. Thus, for example, the equatorial ring can comprise 6, 8, 10, 12, 14, 16, 18, 20, 24, 28, 32, 36, 40, 48, 56, 64, 72, 80, 96, 112, 128, 144, 160, 192, 224, 256, 288, 320, 384, 448, 512, 576, 640, 768, 896, or 1,024 hexagons.

The mathematical theory for determining the number, size and shape of each polygon in the present structures is similar to that used for the spherical structures described in U.S. Pat. No. 4,679,361. The formulas described therein can serve as a starting point for the development of the formulas applicable to the present structures. The present structures involve the preparation of an ellipsoid of revolution, obtained by rotating an ellipse about its minor axis, also called an oblate spheroid. The major complicating factor in the treatment of an ellipsoid as opposed to a sphere is the nonuniformity of the curve in an ellipsoid.

If "e" is the ratio of major to minor axes for an ellipse, and the length of the semi-major axis is 1, then the equation for the unit sphere $$x^2+y^2+z^2=1$$

is replaced by $$x^2+y^2+e^2z^2=1$$

for the ellipsoid. The equations for the planes which intersect the ellipsoid to form ellipses are the same as in the spherical case, as are the methods for finding the values of "d" and "theta" in the equations of the planes which ensure the proper tangency relations among the ellipses. As in the spherical case, the edges of the desired polyhedral structure are the common tangents to the ellipses at points of contact, but in the ellipsoidal case the lengths of these edges and the interior angles of the polygonal faces are found by methods which differ from those used in the spherical case. The procedures appropriate to the present ellipsoidal structures are as follows.

The value of "d" corresponding to a given "theta," to make adjacent ellipses tangent in the same ring, is given by the formula:

$$d^2=1/e^2-\cos^2 \text{theta}\ (1/e^2-\cos^2(\text{phi})) \qquad (1)$$

where phi is 180°/n and n is the number of ellipses in the ring.

To find d and theta for an ellipse in a new ring, given $d_1$, $\text{theta}_1$ and $\text{phi}_1=180°/n_1$, for the old ring, a value for theta is first assumed. Then equation (1) is used with phi=180°/n for the new ring to obtain a value for d. These values of d and theta, along with the known values of d, theta, and phi, are substituted in the expression $$e^2(Ad-B\sec(\text{theta}_1),\cos(\text{theta}))^2+\sin^2(\text{theta})(B^2\sec^2(\text{theta}_1)-A^2)+\sin^2\text{phi}_1(e^2(d^2-\cos^2\text{theta})-\sin^2\text{theta}) \quad (2)$$

where $A=\cos\text{phi}_1-\tan\text{theta}$, cot theta and $$B=d_1-d\sin\text{theta},\csc\text{theta}.$$

If the value of (2) is zero, the values of d and theta are the desired ones. If the value of (2) is greater than zero, the assumed value of theta is too large, while if the value of (2) is negative, the assumed value of theta is too small. These facts, together with the fact that theta must lie between $\text{theta}_1$ and 90°, allow the determination of the proper value of theta, and hence d, by the well-known method of bisection.

Any vertex of the polyhedron is the intersection of three planes. The equation of the plane of an ellipse characterized by values of d, theta and phi is $$x\cos(\text{theta})\cos(\text{phi})+y\cos(\text{theta})\sin(\text{phi})+z\sin(\text{theta})=d \quad (3)$$

Since this is linear in x, y, and z, three such equations can be solved for the coordinates of the vertex which is their point of intersetion. Having the representative coordinates $x_1$, $y_1$, $z_1$ and $x_2$, $y_2$, $z_2$ of adjacent vertices, the length of the edge joining these can be determined by the formula:

$$1=((x_1-x_2)^2+(y_1-y_2)^2+(z_1-z_2)^2)^{\frac{1}{2}} \quad (4)$$

Having the lengths $1_1$ and $1_2$ of edges forming an interior angle alpha of a polygonal face, and the distance $1_3$ between the vertices at the outer ends of those edges, the value of alpha can be determined from the equation $$\cos\text{alpha}=\frac{l_1^2+l_2^2-l_3^2}{2(l_1l_2)} \quad (5)$$

The edge lengths and interior angles of the polygonal faces of the polyhedron are sufficient to characterize it completely. However, it is useful to have a number of other expressions.

The coordinates of the point of contact between an ellipse characterized by theta, d, and longitude zero, and one characterized by theta, $d_1$, and longitude phi, can be obtained from the following three formulas:

$$x=\frac{e^2d\csc(\text{theta})\cot(\text{theta})+AB\csc^2(\text{phi}),\sec(\text{theta})}{1+e^2\cot^2\text{theta}+A^2\csc^2\text{phi}_1} \quad (6)$$

$$y=\csc(\text{phi}_1)(B\sec(\text{theta}_1)-Ax)$$
$$z=d\csc(\text{theta})-x\cot(\text{theta})$$

where A and B are as in (2)

If the ellipses are in the same ring, formulas (6) can still be used by letting $d_1=d$ and $\text{theta}_1=\text{theta}$, and adjusting $\text{phi}_1$ to the proper value for ellipses in the same ring. In the alternative, simpler expressions can be used which result from these substitutions in formulas (6), namely:

$$x=\frac{e^2d\cot(\text{theta})\csc(\text{theta})}{e^2\cot^2(\text{theta})+\csc^2(\text{phi})} \quad (7)$$

$$y=x(\csc(\text{phi})-\cot(\text{phi}))$$
$$z=d\csc(\text{theta})-x\cot(\text{theta})$$

Formulas (7) assume that one ellipse is centered at longitude zero, and the other at longitude phi, with d given in (1) and theta known.

The ellipse centered at longitude zero and defined by the equations:

$$d=x\cos(\text{theta})+z\sin(\text{theta})$$

$$y=0$$

$$x^2+y^2+e^2z^2=1$$

has its center at $$x=de^2\cos(\text{theta})/A$$

$$y=0$$

$$z=d\sin(\text{theta})/A$$

where $A=\sin^2(\text{theta})+e^2\cos^2(\text{theta})$

The semi-major axis of the ellipse is $$(1-e^2d^2/A)^{\frac{1}{2}}$$

and the ratio of major to minor axes is $A^{\frac{1}{2}}$

If $\text{theta}_n$ and $d_n$ characterize an ellipse in the highest ring, then the length of a side of the polar polygon is given by the formula:

$$\frac{2\tan(\text{phi}_n)\ (e^2d_n\csc\text{theta}_n\cot\text{theta}_n-(e^2\csc^2\text{theta}_n(1-d_n^2)+1-e^2)^{\frac{1}{2}}}{1+e^2\cot^2\text{theta}_n}$$

where $d_n$ is related to thetan as in (1), with n the number of ellipses in the upper ring, which also equals the number of sides of the polar polygon.

Figure 2:
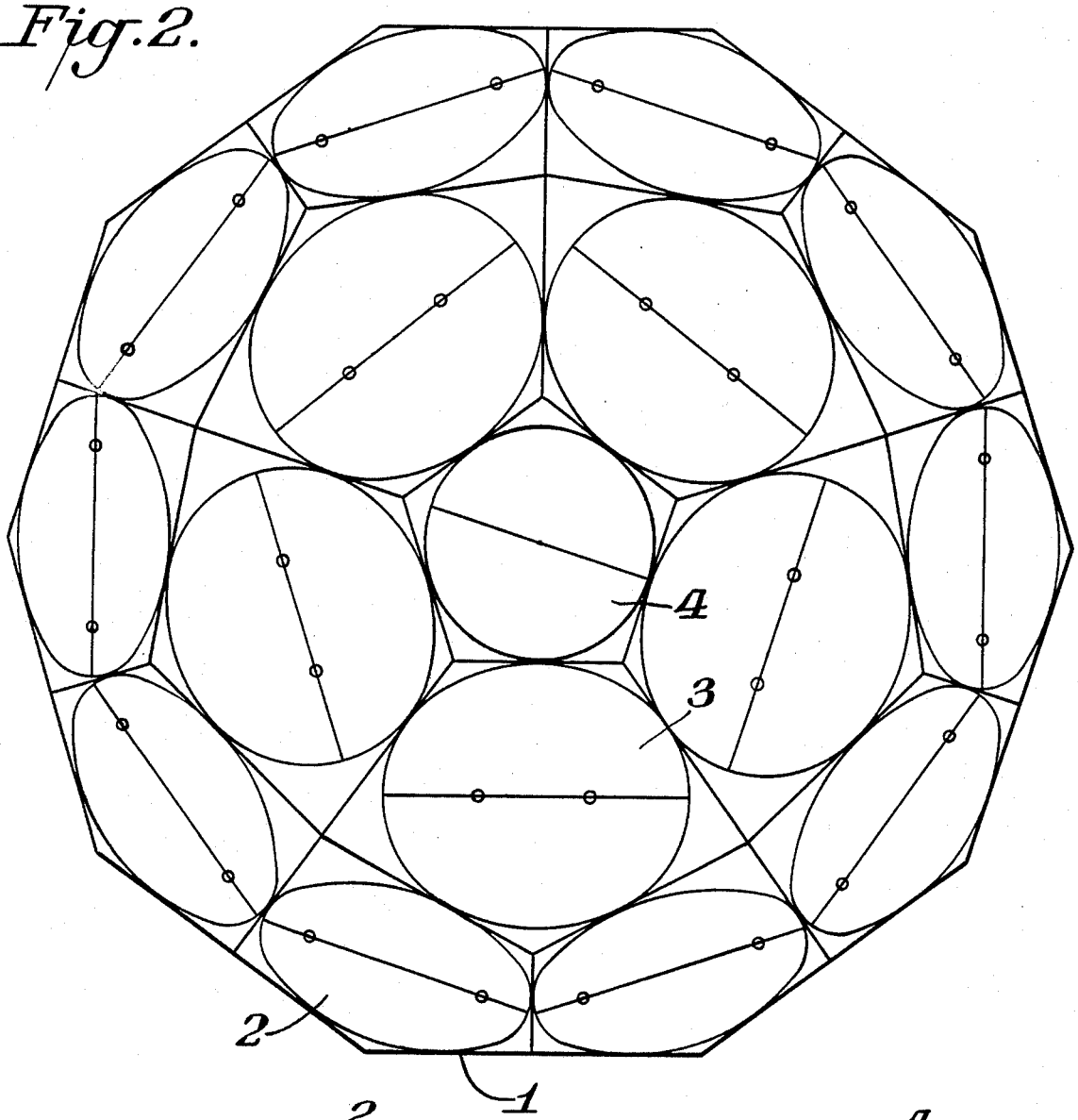
FIG. 2 is a polar view of the dome of FIG. 1.

A construction of one embodiment of the present invention is more fully illustrated in FIG. 1, in which ten equatorial hexagons 1 are present, the inscribed ellipses of which, shown by dotted lines, are tangent to each other. The next most polar ring is composed of ten pentagons 2, the inscribed ellipses of which are tangent to each other and those of the equatorial ring. The closest approximation to the preceding ring for the polar-most ring is achieved by reducing the number of polygons by one-half, resulting in pentagons 3. Polar caps 4, one of which is shown in FIG. 2, are regular pentagons.

Figure 3:
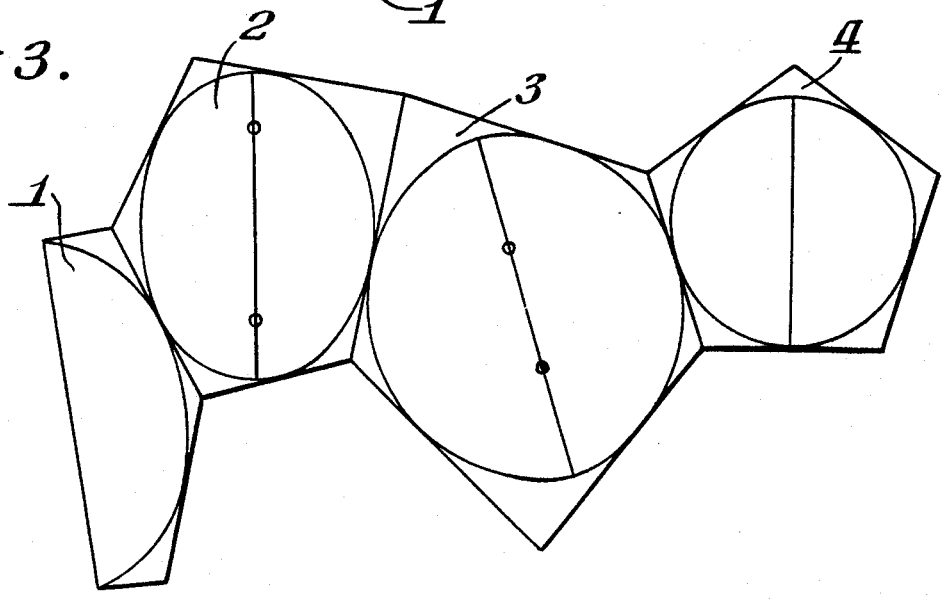
FIG. 3 is a plane view of representative polygonal faces which can be used to make up the dome of FIGS. 1 and 2.

The elements of this polyhedron, in a planar arrangement, are illustrated in FIG. 3. In that Figure, one-half of equatorial hexagon 1 is shown, and the inscribed ellipse is tangent to that of the polygon 2 of the next most polar ring. This, in turn, is tangent to the inscribed ellipse of polygon 3 which, in turn, is tangent to the inscribed ellipse of polar polygon 4.

The present elliptical geotangent dome system provides a combination of advantages not found in earlier domes. In the present structures, an equatorial band of faces is provided that are congruent and stand perpendicular to the foundation, all at the same height. This enhances foundation connections and facilitates installation of architectural elements such as doors and windows. The size and shape of the dome can be adjusted to produce domes with an infinite variety of height to diameter ratios.

The size and shape of the dome faces can be varied to produce domes with few or many faces. This feature allows creation of a variety of dome sizes with relatively constant face sizes.

A further advantage of the present invention is that only three or four struts join at any vertex. This results in simple, stronger joints, than, for example, the geodesic dome. Moreover, the struts and vertex joints do not continuously follow along the great circle pathway as defined for a geodesic dome. The circular pathways in a geodesic dome, by contrast, create stress and weaknesses along those line.

The pentagonal and hexagonal faces in a geotangent dome are more compatible with rectangular building components than the triangular faces found in geodesic domes.

The domes of the present invention can be constructed using the materials and building techniques described in U.S. Pat. No. 4,679,361. In addition, the frameworks defined by such domes, that is, either the framework defined by the edges of the polygons or their inscribed ellipses, can be useful per se.

The invention is further illustrated by the following Examples, in which the shape and size of the polygonal faces are determined by the mathematical techniques described above.

EXAMPLE 1

An elliptical dome with a diameter to height ratio of $\frac{2}{3}$ was constructed having an equatorial ring of 10 pentagons, followed by a second ring of 10 pentagons which were 5 pairs of mirror images, followed by a third ring of 5 pentagons and a pentagonal polar cap. With reference to FIGS. 1 and 3, the corner angles and edge lengths for the polygons in each ring are summarized as follows:

| Side | Length | Corner | Angle (degrees) |
|---|---|---|---|
| | Equatorial ring - 10 equal pentagons | | |
| a | 0.1209 | A | 90 |
| b | 0.3297 | B | 110.414 |
| c | 0.3297 | C | 139.172 |
| d | 0.1209 | D | 110.414 |
| e | 0.6180 | E | 90 |
| | Second ring - 10 pentagons | | |

-continued

| Side | Length | Corner | Angle (degrees) |
|---|---|---|---|
| a | 0.3688 | A | 105.233 |
| b | 0.4713 | B | 88.921 |
| c | 0.2621 | C | 114.531 |
| d | 0.3294 | D | 105.233 |
| e | 0.3297 | E | 126.082 |
| | Third ring - 5 pentagons | | |
| a | 0.4474 | A | 83.826 |
| b | 0.3292 | B | 124.07 |
| c | 0.4494 | C | 124.07 |
| d | 0.4713 | D | 83.826 |
| e | 0.4713 | E | 124.208 |

Polar pentagon - 5 equal sides of 0.3292

I claim:

1. A polyhedral structure that approximates a non-spherical ellipsoid, the ellipsoid having an equator and two poles, the structure composed of two polar faces and at least three rings of polygonal faces, the polygonal faces having from 4 to 8 sides, including at least one ring closest to each pole and at least one ring at or adjacent the equator, wherein each face in a ring is at the same latitude of the ellipsoid and each edge of each polygon is tangent to the approximated ellipsoid at one point, and in which each ring of polygons at or closest to the equator contains more faces than the most polar rings.

2. A polyhedral structure of claim 1 wherein all faces in each ring of polygons are congruent or mirror images of each other.

3. A polyhedral structure of claim 1 wherein the equatorial ring consists of at least 8 polygonal faces equal in number to a power of two times an odd integer of from 1 to 9.

4. A dome formed by a section of a polyhedral structure that approximates a non-spherical ellipsoid, the ellipsoid having an equator and two poles, the structure composed of two polar faces and at least three rings of polygonal faces, the polygonal faces having from 4 to 8 sides, including at least one ring closest to each pole and at least one ring at or adjacent the equator, wherein each face in a ring is at the same latitude of the ellipsoid and each edge of each polygon is tangent to the approximated ellipsoid at one point, and in which each ring of polygons at or closest to the equator contains more faces than the most polar rings.

5. A dome of claim 4 wherein the faces of the dome are comprised of framework elements at the edges and vertexes of the polygons.

6. A polyhedral structure of claims 1 or 4 wherein the polyhedral structure is comprised of elliptical framework elements inscribed in the polygonal faces and joined at the points at which the elliptical framework elements are tangent to each other.

* * * * *